United States Patent [19]

Marthaler et al.

[11] 4,304,846

[45] Dec. 8, 1981

[54] METHOD FOR PROCESSING SILVER DYE-BLEACH MATERIALS

[75] Inventors: Max Marthaler, Marly; Gérald Jan, Fribourg, both of Switzerland

[73] Assignee: Ciba-Geigy AG, Basel, Switzerland

[21] Appl. No.: 118,245

[22] Filed: Feb. 4, 1980

[30] Foreign Application Priority Data

Feb. 9, 1979 [CH] Switzerland ..... 1293/79

[51] Int. Cl.[3] ..... G03C 7/00

[52] U.S. Cl. ..... 430/392; 430/393; 430/462

[58] Field of Search ..... 430/392, 393, 462

[56] References Cited

U.S. PATENT DOCUMENTS

| | | | |
|---|---|---|---|
| 2,304,987 | 12/1942 | Young | 430/392 |
| 2,322,084 | 6/1943 | Young et al. | 430/392 |
| 3,394,004 | 7/1968 | Anderau et al. | 430/392 |
| 3,429,705 | 2/1969 | Piller | 430/392 |
| 3,656,953 | 4/1972 | Schlunke et al. | 430/392 |
| 3,796,576 | 3/1974 | Schlunke et al. | 430/392 |
| 4,145,217 | 3/1979 | Jan et al. | 430/392 |
| 4,202,698 | 5/1980 | Jan et al. | 430/462 |

*Primary Examiner*—Mary F. Downey

*Attorney, Agent, or Firm*—Sprung, Felfe, Horn, Lynch & Kramer

[57] ABSTRACT

A method for processing exposed silver dye-bleach materials using novel preparations for combined dye bleaching and silver bleaching is described. In addition to a strong acid, a water-soluble iodide, a water-soluble oxidizing agent, an antioxidant and, if desired, a bleaching accelerator, these preparations also contain a mixture of 1,4- or 1,2-diazines as bleach catalysts. This mixture consists either of at least two bleach catalysts with redox potentials between +105 mV and −30 mV, the difference between the redox potentials of the catalysts being at least 15 mV, or of at least one bleach catalyst with a redox potential between +60 mV and −30 mV and at least one bleach catalyst with a redox potential between −30 mV and −100 mV, the difference between the redox potentials of the catalysts likewise being at least 15 mV.

When exposed dye-bleach materials are processed using these preparations, images with improved color quality are obtained.

26 Claims, 3 Drawing Figures

METHOD FOR PROCESSING SILVER DYE-BLEACH MATERIALS

Figure 1:
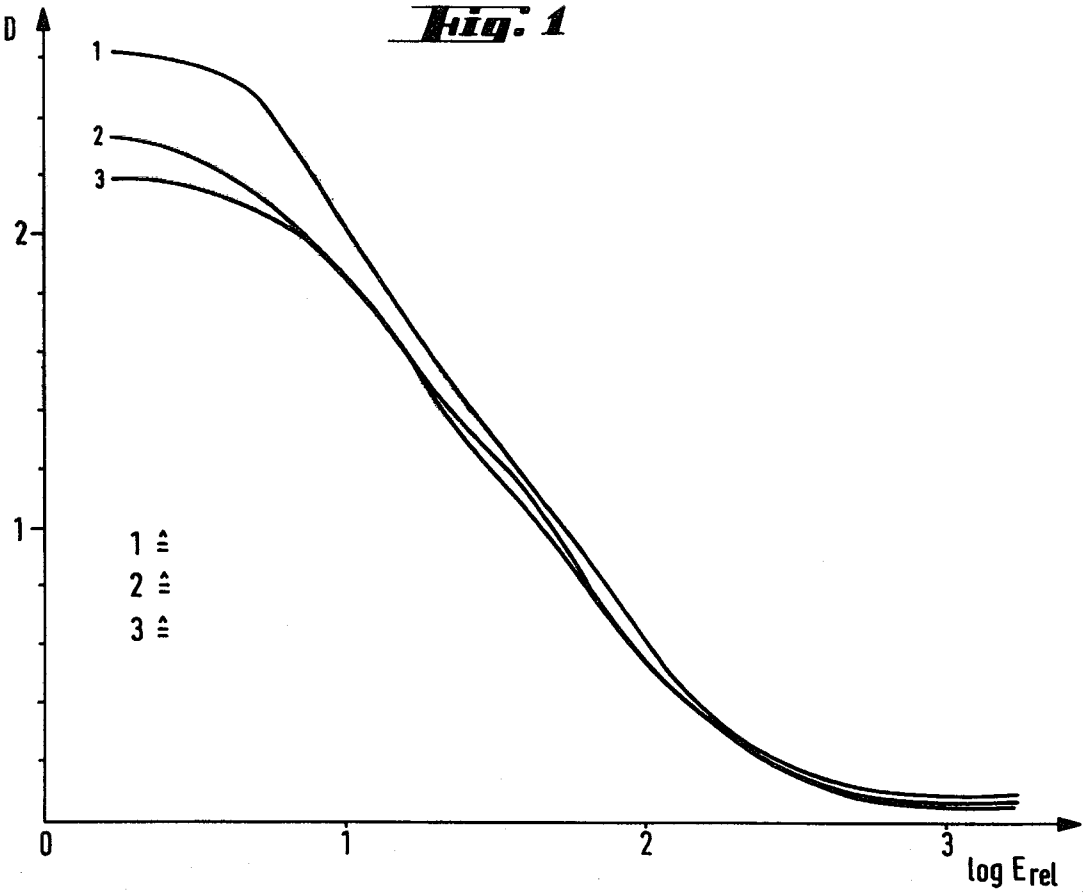

Processing of exposed silver dye-bleach materials is in general effect in four consecutive steps:

1. Silver developing
2. Dye bleaching
3. Silver bleaching
4. Fixing.

In the first step the latent silver image formed during exposure is developed. In the second step the image dye assigned to the silver is bleached out, corresponding to the existing image-wise distribution of the silver. The third step is necessary in order to reoxidise the excess image silver still present after dye-bleaching. In the fourth step, the silver, which is now entirely in the form of halides, is removed by dissolving out with a complexing agent, especially a salt of thiosulfuric acid, in order to render the finished image insensitive to further exposure and to free the pure coloured image from cloudiness.

With the conventional known processes, the second process step, dye bleaching, is carried out in a strongly acid medium and in order to accelerate dye bleaching a catalyst is added. The bleaching baths also contains a silver complexing agent or ligands. The two constituents, catalyst and ligand, are necessary in order to transfer the reducing action of the metallic, non-diffusible image silver to the dye, which is likewise non-diffusible. The reduced form of the catalyst, which forms as a result of reduction on the image silver, serves as an intermediate carrier which, after it has covered a certain diffusion distance, irreversibly reduces, and thus bleaches, the dye and in so doing is itself reoxidised to its original form.

The characteristic of the bleach catalyst in its reduced form of freely diffusing between image silver and dye to be bleached makes it possible spatially to separate the silver and the image dye to a certain extent, i.e. makes it possible for the bleachable dye and the silver halide emulsion assigned thereto to be arranged in adjacent layers and not, or only partially, in the same layer. Silver dye-bleach materials of this type are described, for example, in German Offenlegungsschriften Nos. 2,036,918, 2,132,835 and 2,132,836.

A simplified version of the processing procedure, in which dye bleaching and silver bleaching are combined in a single process step, has been described in German Offenlegungsschrift No. 2,448,433. By means of a special arrangement of iodide-containing and iodide-free silver halide emulsions, the use of a seed-containing interlayer and the addition of small amounts of a silver complexing agent, such as sodium thiosulfate, to the developer, as has been described in German Offenlegungsschrift No. 2,547,720, it is even possible to develop the process described in German Offenlegungsschrift No. 2,448,433 to a self-masking process, as a result of which a reproduction of the natural colours which is considerably more true to nature is obtained.

Suitable bleach catalysts, which under the influence of the image silver in acid solution are reversibly reduced and, in turn, are able reductively to bleach the image dyes, are, in particular, 1,4-diazines, such as pyrazine, quinoxaline, phenazine and its derivatives, and also 1,2-diazines, such as cinnoline and its derivatives, such as benzo- or pyrido-[c]-cinnolines. Suitable bleach catalysts are listed in a large number of patent specifications and patent applications, for example in German Patent Specification No. 735,672, German Auslegeschrift No. 1,547,720 and German Offenlegungsschriften Nos. 2,144,297, 2,144,298, 2,722,776 or 2,722,777.

In recent years, the silver dye-bleach positive images produced by the known process have been brought to a state of high perfection and are distinguished, in particular, by brilliant colours, good colour reproduction and excellent fastness to light. An important characteristic of a good colour copying material is an optimum tone reproduction and colour gradations balanced in all density ranges. The control of the colour balance in particular continues to present difficulties, since different bleaching characteristics of the azo dyes cannot always be compensated by the conventional methods for building up the material, such as the sensitivity and contrast of the silver emulsions employed. As a result, the choice of the image dyes and also, in particular, that of the processing components in the bleaching bath, is frequently restricted.

It is possible, without difficulty, to influence the sensitometric characteristics of all emulsion layers of a silver dye-bleach material by the choice of a suitable catalyst and of the amount of this catalyst used in the bleaching bath, and to shift the gradation and/or the sensitivity in either direction, as desired. If the three-bath process according to German Offenlegungsschrift No. 2,448,433 or the self-masking variant according to German Offenlegungsschrift No. 2,547,720 is used, there are further possibilities for influencing the sensitometry, in that in these cases the amount of an oxidant (an aromatic nitro compound) used in the bleaching bath is varied relative to the amount of the bleach catalyst (a diazine compound), or in that oxidants of different redox potentials are used. Thus, for example, in more strongly oxidising bleaching baths a less steep gradation is obtained whilst with more weakly oxidising baths, on the other hand, a steeper gradation is obtained. Specific groups of bleach catalysts are also known which result in a different sensitivity and/or gradation, corresponding to their higher or lower redox potential. However, in cases where the colour balance has been upset it has to date never proved possible by means of the variants described to bring the sensitometric curves for all three colour layers virtually into complete alignment and thus to obtain the same neutral colour reproduction within the entire density scale of an image.

The object of the present invention is to correct the disturbed colour balance as far as possible, in order thus to obtain an improved colour reproduction.

It has now been found that it is possible substantially to obtain the desired alignment of the sensitometric curves by the simultaneous use of at least two bleach catalysts which have redox potentials differing by at least 15 mV.

The present invention therefore relates to a method for processing exposed silver dye-bleach materials using the process steps (1) silver developing, (2) dye bleaching and silver bleaching, (3) silver fixing and (4) washing, a preparation which contains (a) a strong acid, (b) a water-soluble iodide, (c) a water-soluble oxidising agent, (d) an antioxidant, (e) 1,4- or 1,2-diazines as bleach catalysts and optionally (f) a bleaching accelerator being used for the combined dye bleaching and silver bleaching, wherein a mixture of at least one bleach catalyst (I) with a redox potential between +105 mV and −30 mV and ($a_1$) at least one bleach catalyst from the same group or ($a_2$) at least one bleach catalyst (II) wit a redox potential between −30 and −125 mV is used as component (e), the difference between the redox potentials of the bleach catalysts being at least 15 mV.

The redox potentials are measured with a calomel electrode in 1.0 molar aqueous sulfuric acid solution against the standard hydrogen electrode. The ratio of the bleach catalysts to one another can vary between 1:200 and 200:1.

Preferably, the ranges of the redox potentials are between +60 mV and −30 mV (bleach catalyst I) and −30 mV and −100 mV (bleach catalyst II).

1,2-Diazines suitable as components (e) which have redox potentials within the indicated limits are substituted or unsubstituted benzo- or pyrido-[c]-cinnolines, and 1,4-diazines suitable as components (e) which have redox potentials within the indicated limits are substituted or unsubstituted pyrazines and especially quinoxalines. The latter are preferably substituted, for example in positions 2, 3, 5, 6, 7 and/or 8 and preferably in positions 2, 3, 6 and/or 7. As a rule, up to 4 substituents are present in the molecule. The quinoxalines can be substituted by methyl, methoxy, hydroxymethyl, sulfomethyl, sulfoethoxy or sulfopropoxy or also by hydroxyl, amino(—$NH_2$), acetylamino or methylsulfonylamino, and can also be fused with 5-membered or 6-membered rings, such as dioxolo, dioxino, imidazo or pyrazino rings.

The best results are obtained when catalysts from one of the groups I and II are so selected that, in each case, at least one representative from group I and at least one further representative from one of the groups I or II are used at the same time. The two groups each comprise, within themselves, in principle those catalysts having a higher redox potential (group I) and those catalysts having a lower redox potential (group II). When selecting suitable representatives, it must be ensured that the condition that the minimum difference in the redox potentials is 15 mV is met in every case.

The first group (I) of catalysts with a redox potential between +105 mV and −30 mV, and preferably between +60 mV and −30 mV, contains, for example, the following compounds: 2,3-dimethyl-quinoxaline, 2,3,6-trimethyl-quinoxaline, 6-methoxy-2,3-dimethyl-quinoxaline, 6-hydroxy-2,3-dimethyl-quinoxaline, 6-(2-hydroxy-ethoxy)-2,3-dimethyl-quinoxaline, 6-(3-sulfopropoxy)-2,3-dimethyl-quinoxaline, 6-amino-2,3,7-trimethyl-quinoxaline, 6-amino-2,3-dimethyl-quinoxaline, 6-hydroxymethyl-2,3-dimethyl-quinoxaline, 6-sulfomethyl-2,3-dimethyl-quinoxaline, 6-acetamido-2,3-dimethyl-quinoxaline, 6-acetamido-2,3,7-trimethyl-quinoxaline, 6-methanesulfonamido-2,3-dimethyl-quinoxaline, 6-methanesulfonamido-2,3,7-trimethyl-quinoxaline, 6,7-dimethoxy-quinoxaline, 2,3-dihydro-7-methyl-8-sulfomethyl-dioxino-[2,3-g]-quinoxaline, 3-hydroxy-benzo-[c]-cinnoline and 3-(3-sulfopropoxy)-benzo-[c]-cinnoline, 2,6,7-trimethyl-imidazo-[4,5-g]-quinoxaline and 6,7-dimethyl-imidazo-[4,5-g]-quinoxaline.

The second group (II) of catalysts with a redox potential between −30 mV and −125 mV, and preferably between −30 mV and −100 mV, contains, for example, the following compounds: 6-hydroxy-2,3,7-trimethyl-quinoxaline, 6,7-dimethoxy-2,3-dimethyl-quinoxaline, 6,7-dimethyl-dioxolo-[4,5]-quinoxaline, 6-methoxy-2,3,7-trimethyl-quinoxaline, 2,3,6,7-tetramethyl-quinoxaline, 6-amino-7-methoxy-2,3-dimethyl-quinoxaline, 6-methoxy-2,3-dimethyl-7-(3-sulfopropoxy)-quinoxaline, 6,7-dimethoxy-2-methyl-3-sulfomethyl-quinoxaline, 6-methoxy-2,3-dimethyl-7-(2-sulfoethoxy)-quinoxaline, 2-hydroxymethyl-6,7-dimethoxy-3-methyl-quinoxaline, 6-methyl-dioxolo-[4,5-g]-quinoxaline, 6-methyl-7-sulfomethyl-dioxolo-[4,5-g]-quinoxaline, 2,3-dihydro-7,8-dimethyl-dioxino-[2,3-g]-quinoxaline, 6-hydroxy-7-methoxy-2,3-dimethyl-quinoxaline, 2,3-dihydro-7-hydroxymethyl-8-methyl-dioxino-[2,3-g]-quinoxaline, 5-amino-6-methoxy-2,3-dimethyl-quinoxaline, 2,7,8-trimethyl-imidazolo-[4,5-f]-quinoxaline, 4-methoxy-2,7,8-trimethyl-imidazolo-[4,5-f]-quinoxaline, 7,8-dimethyl-imidazolo-[4,5-f]-quinoxaline, 4-methoxy-7,8-dimethyl-imidazolo-[4,5-f]-quinoxaline, 2,3,8,9-tetramethyl-pyrazino-[2,3-g]-quinoxaline, 5-amino-2,3-dimethyl-quinoxaline, pyrazine and methylpyrazine.

Important characteristics of these catalysts, in addition to the fact that they belong to one of the groups I and II characterised according to their redox potentials, are a slight inherent colour and also an adequate solubility in acid aqueous baths.

Suitable bleach catalysts from the two groups I and II are listed, together with the corresponding redox potentials, in Tables 1 and 2 below.

TABLE 1

Catalysts of group I: redox potential +105 to −30 mV
Polarographic redox potential, measured in 1.0 M sulfuric acid (standard hydrogen electrode)

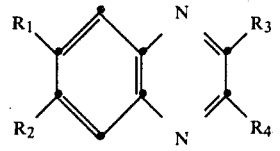

| No. | $R_1$ | $R_2$ | $R_3$ | $R_4$ | Redox potential (mV) |
|---|---|---|---|---|---|
| 101 | —H | —H | —$CH_3$ | —$CH_3$ | +18 |
| 102 | —H | —$CH_3$ | —$CH_3$ | —$CH_3$ | +2 |
| 103 | —$OCH_3$ | —H | —$CH_3$ | —$CH_3$ | −24 |
| 104 | —OH | —H | —$CH_3$ | —$CH_3$ | −22 |
| 105 | HO—$CH_2CH_2O$— | —H | —$CH_3$ | —$CH_3$ | −20 |
| 106 | $NaO_3S(CH_2)_3O$— | —H | —$CH_3$ | —$CH_3$ | −20 |
| 107 | —$CH_3$ | —$NH_2$ | —$CH_3$ | —$CH_3$ | +12 |
| 108 | —H | —$NH_2$ | —$CH_3$ | —$CH_3$ | +36 |
| 109 | —H | —$CH_2OH$ | —$CH_3$ | —$CH_3$ | +4 |
| 110 | —H | —$CH_2SO_3H$ | —$CH_3$ | —$CH_3$ | +33 |
| 111 | —H | —NH . $COCH_3$ | —$CH_3$ | —$CH_3$ | +18 |
| 112 | $CH_3CO$—NH— | —$CH_3$ | —$CH_3$ | —$CH_3$ | −12 |
| 113 | —H | —NH . $SO_2CH_3$ | —$CH_3$ | —$CH_3$ | +18 |

TABLE 1-continued

Catalysts of group I: redox potential +105 to −30 mV
Polarographic redox potential, measured in 1.0 M sulfuric acid (standard hydrogen electrode)

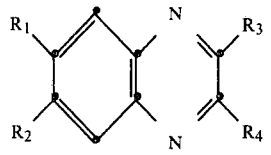

| No. | $R_1$ | $R_2$ | $R_3$ | $R_4$ | Redox potential (mV) |
|---|---|---|---|---|---|
| 114 | $CH_3—SO_2—NH—$ | $—CH_3$ | $—CH_3$ | $—CH_3$ | −10 |
| 115 | $—OCH_3$ | $—OCH_3$ | —H | —H | −7 |
| 116 | $—O—CH_2—CH_2—O—$ | | $—CH_2SO_3Na$ | $—CH_3$ | 0 |
| 117 | 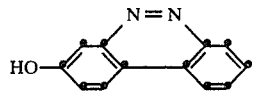 | | | | +50 |
| 118 | 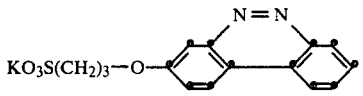 | | | | +50 |
| 119 | 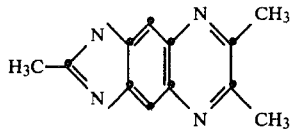 | | | | +38 |
| 120 | 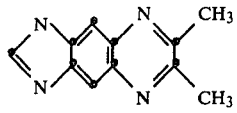 | | | | +103 |

TABLE 2

Catalysts of group II: redox potential −30 to −125 mV
Polarographic redox potential, measured in 1.0 M sulfuric acid (standard hydrogen electrode)

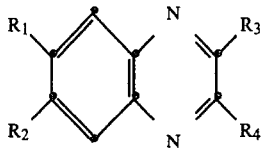

| No. | $R_1$ | $R_2$ | $R_3$ | $R_4$ | Redox potential (mV) |
|---|---|---|---|---|---|
| 201 | —OH | $—CH_3$ | $—CH_3$ | $—CH_3$ | −46 |
| 202 | $—OCH_3$ | $—OCH_3$ | $—CH_3$ | $—CH_3$ | −64 |
| 203 | | $—O—CH_2—O—$ | $—CH_3$ | $—CH_3$ | −103 |
| 204 | $—OCH_3$ | $—CH_3$ | $—CH_3$ | $—CH_3$ | −75 |
| 205 | $—CH_3$ | $—CH_3$ | $—CH_3$ | $—CH_3$ | −34 |
| 206 | $—OCH_3$ | $—NH_2$ | $—CH_3$ | $—CH_3$ | −44 |
| 207 | $—OCH_3$ | $H_4NO_3S(CH_2)_3O—$ | $—CH_3$ | $—CH_3$ | −81 |
| 208 | $—OCH_3$ | $—OCH_3$ | $—CH_2SO_3Na$ | $—CH_3$ | −38 |
| 209 | $—OCH_3$ | $H_4NO_3S(CH_2)_2O—$ | $—CH_3$ | $—CH_3$ | −80 |
| 210 | $—OCH_3$ | $—OCH_3$ | $—CH_2OH$ | $—CH_3$ | −66 |
| 211 | | $—O—CH_2—O—$ | —H | $—CH_3$ | −41 |
| 212 | | $—O—CH_2—O—$ | $—CH_2SO_3Na$ | $—CH_3$ | −66 |
| 213 | | $—O—CH_2—O—$ | $—CH_2OH$ | $—CH_3$ | −95 |
| 214 | | $—O—CH_2—CH_2—O—$ | $—CH_3$ | $—CH_3$ | −36 |
| 215 | $—OCH_3$ | —OH | $—CH_3$ | $—CH_3$ | −79 |
| 216 | | $—O—CH_2—CH_2—O—$ | $—CH_2OH$ | $—CH_3$ | −44 |
| 217 | | 5-amino-6-methoxy-2,3-dimethylquinoxaline | | | −87 |
| 218 | | 5-amino-2,3-dimethyl-quinoxaline | | | −74 |
| 219 | 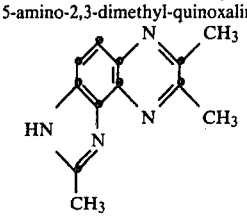 | | | | −30 |

TABLE 2-continued

Catalysts of group II: redox potential −30 to −125 mV
Polarographic redox potential, measured in 1.0 M sulfuric acid (standard hydrogen electrode)

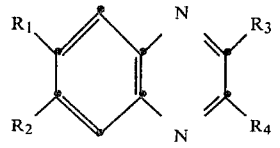

| No. | $R_1$ | $R_2$ | $R_3$ | $R_4$ | Redox potential (mV) |
|---|---|---|---|---|---|
| 220 | | 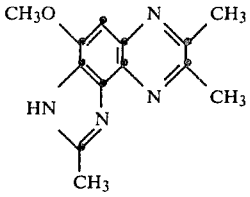 | | | −122 |
| 221 | | 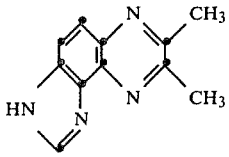 | | | −30 |
| 222 | | 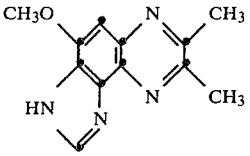 | | | −97 |
| 223 | | 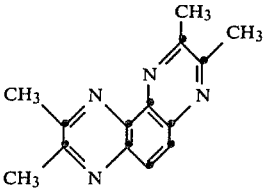 | | | ≈−50 |
| 224 | | 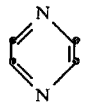 | | | −33 |
| 225 | | 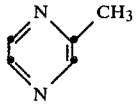 | | | −83 |

The present invention also relates to the combined dye bleaching and silver bleaching baths (preparations) for processing the exposed silver dye-bleach material, which contain components (a) to (e) and, if desired, (f).

The amount in which the bleach catalysts are employed in the treatment baths, which preferably are aqueous, can vary within wide limits and is about 0.05 to 10 g/l of bleaching bath.

The temperature of the bleaching bath is in general between 20° and 90° C. and preferably between 20° and 60° C. and, of course, the necessary processing time is shorter at a higher temperature than at a lower temperature. The bleaching baths are stable within the indicated temperature range. In general, the aqueous bleaching preparations required for processing are used in the form of dilute aqueous solutions which contain the said components. However, other methods are also conceivable, for example use in paste form.

The said temperature range also applies for the other processing steps. The aqueous bleaching preparation according to the present invention can be prepared, for example, from liquid, especially aqueous, concentrates of individual components or of all the components ((a) to (f)). Advantageously, for example, two liquid concentrates are used, one of which contains the strong acid (a) and the oxidising agent (c) and the other of which contains the remaining components (b), (d), (e) and optionally (f), it being possible to add an additional solvent, such as ethyl alcohol or propyl alcohol, ethylene glycol methyl ether or ethylene glycol ethyl ether, to the latter concentrates in order to improve the solubility, especially of component (e). These concentrates (partial concentrates), which are likewise a subject of the present invention, have excellent stability and can therefore be stored for a prolonged period. These concentrates can be diluted if desired, by dilution with water or with a mixture of water and an organic solvent, and used in the process according to the invention.

The aqueous bleaching preparations which are used as a rule contain components (a) to (f) in the following amounts: (a) strong acid: 10 to 200 g/l, (b) water-soluble iodide: 2 to 50 g/l and preferably 5 to 25 g/l; (c) water-soluble oxidising agent: 1 to 30 g/l; (d) anti-oxidant: 0.5 to 10 g/l; (e) bleach catalysts: 0.05 to 10 g/l, and, if desired, (f) bleaching accelerator: 1 to 5 g/l.

The concentrates of the individual components or of all the components or of combinations thereof, for example of components (a) and (c) and of components (b), (d), (e) and (f), can contain, per liter of concentrated preparation, 2 to 20 times and preferably 5 to 10 times the amount of the individual components which has been indicated above for the ready-to-use bleaching baths. The concentrates are as a rule in liquid or paste form and can also be in powder form.

The strong acids (component (a)) contained in the combined dye bleaching and silver bleaching baths can be alkyl- or aryl-sulfonic acids and especially p-toluenesulfonic acid, sulfuric acid or sulfamic acid. If desired, mixtures of these acids can also be employed. The pH value of the bleaching bath is in particular not higher than 2 and preferably not higher than 1.

The water-soluble iodides (component (b)) are as a rule alkai metal iodides, especially sodium iodide and potassium iodide.

The oxidising agents (c) used are advantageously water-soluble aromatic mononitro and dinitro compounds, as well as anthraquinonesulfonic acid derivatives. The use of such oxidising agents serves to influence the colour balance and the contrast in the images produced by the dye-bleach process and has been disclosed in German Patent Specification No. 735,672, British Patent Specifications No. 539,190 and 539,509 and Japanese Patent Publication No.

22,673/69.

The mononitro and dinitro compounds are preferably mono- or di-nitrobenzenesulfonic acids, for example those of the formula (1)

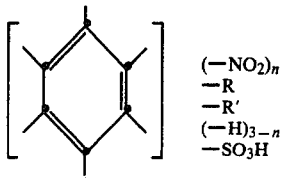

in which n is 1 or 2 and R and R' are hydrogen, lower alkyl having 1 to 4 carbon atoms, alkoxy, amino or halogen (chlorine or bromine). The sulfonic acids can be added in the form of readily soluble salts. Suitable compounds are, for example, the sodium or potassium salts of the following acids: o-nitrobenzenesulfonic acid, m-nitrobenzenesulfonic acid, 2,4-dinitrobenzenesulfonic acid, 3,5-dinitrobenzenesulfonic acid, 3-nitro-4-chlorobenzenesulfonic acid, 2-chloro-5-nitrobenzenesulfonic acid, 4-methyl-3,5-dinitrobenzenesulfonic acid, 3-chloro-2,5-dinitrobenzenesulfonic acid, 2-amino-4-nitrobenzenesulfonic acid and 2-amino-4-nitro-5-methoxybenzenesulfonic acid.

As well as acting as silver-bleaching agents, the compounds of component (c) serve to level off the gradation.

The antioxidants (anti-corrosive agents) (d) used are advantageously reductones or water-soluble mercapto compounds. Suitable reductones are in particular acireductones containing a 3-carbonyl-1,2-enediol grouping, such as reductine, triose-reductone or preferably ascorbic acid. Suitable mercapto compounds are, for example, thioglycerol, but especially the compounds of the formula (2) $HS—C_qH_{2q}—B$ or preferably (3) $HS—(CH_2)_m—COOH$ in which q is an integer with a value of from 2 to 12, B is a sulfonic acid group or carboxylic acid group and m is one of the numbers 3 and 4. Mercapto compounds which can be used as antioxidants are described in German Offenlegungsschrift No. 2,258,076 and in German Offenlegungsschrift No. 2,423,814. Compounds suitable as further antioxidants are alkali metal, alkaline earth metal or ammonium bisulfite adducts or organic carbonyl compounds, preferably alkali metal or ammonium bisulfite adducts of monoaldehydes having 1 to 4 carbon atoms or of dialdehydes having 2 to 5 carbon atoms (German Offenlegungsschrift No. 2,737,142).

Examples are the particularly preferred formaldehyde-bisulfite adduct and also the corresponding adducts of acetaldehyde, propionaldehyde, butyraldehyde or isobutyraldehyde and of glyoxal, malonaldehyde or glutaraldehyde. If desired, the tertiary, water-soluble phosphines named below as bleaching accelerators can also be used as the same time as antioxidants.

Suitable bleaching accelerators (f) are, for example, quaternary ammonium salts, such as have been disclosed in German Offenlegungsschriften No. 2,139,401 and 2,716,136. They are preferably quaternary, substituted or unsubstituted piperidine, piperazine, pyrazine, quinoline or pyridine compounds, the latter being preferred. Furthermore, tetraalkylammonium compounds (alkyl having 1 to 4 carbon atoms) and alkylenediammonium compounds (alkylene having 2 to 6 carbon atoms) can also be used. Specific compounds are: tetraethylammonium iodide; $(CH_3)_3N^{\oplus}(CH_2)_2N^{\oplus}(CH_3)_3.2I^{\ominus}$; $(CH_3)_3N^{\oplus}(CH_2)_6N^{\oplus}(CH_3)_3.2I^{\ominus}$; N-methylpyridinium iodide; N-methylquinolinium iodide; N-hydroxyethylpyridinium chloride; N-hydroxypropylpyridinium bromide; N-methyl-2-hydroxymethylpyridinium iodide; N,N-dimethylpiperidinium iodide; N,N'-dimethylpyrazinium fluorosulfate and γ-picolinium hydrogen sulfate.

Further bleaching accelerators are the water-soluble tertiary phosphines which are disclosed in German Offenlegungsschrift No. 2,651,969 and which preferably contain at least one cyanoethyl grouping.

They have, for example, the formula

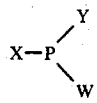

(4)

in which W is $—C_rH_{2r}CN$, $—C_rH_{2r}NO_2$ or a substituted or unsubstituted aryl radical or a heterocyclic radical, r is 1 to 25, X is substituted or unsubstituted alkyl and Y is hydroxyalkyl, alkoxyalkyl, sulfoalkyl, aminoalkyl (alkyl in each case having 1 to 25 and preferably 2 to 4 carbon atoms), phenyl, sulfophenyl or pyridyl. Preferred tertiary phosphines have the formula

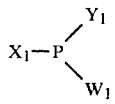

(5)

in which $X_1$ is $—CH_2CH_2CN$ or $—(CH_2)_2OCH_3$, $Y_1$ is $—(CH_2)_2SO_3^{\ominus}M^{\oplus}$, $—(CH_2)_3—SO_3^{\ominus}M^{\oplus}$, $—(CH_2)_4—SO_3^{\ominus}M^{\oplus}$, $—(CH_2)_2OCH_3$ or $—CH_2N(C_2H_5)_2$, $W_1$ is $—CH_2CH_2CN$ or phenyl and $M^{\oplus}$ is a cation, especially an alkali metal cation, for example the sodium or potassium cation.

Specific compounds are the following: bis-(β-cyanoethyl)-2-sulfoethylphosphine (sodium salt), bis-(β-cyanoethyl)-3-sulfopropylphosphine (sodium salt), bis-(β-cyanoethyl)-4-sulfobutylphosphine (sodium salt), bis-(β-cyanoethyl)-2-methoxyethylphosphine, bis-(2-methoxyethyl)-(β-cyanoethyl)-phosphine, (β-cyanoethyl)-phenyl-3-sulfopropylphosphine (sodium salt), (β-cyanoethyl)-phenyl-2-methoxyethylphosphine and bis-(2-methoxyethyl)-phenylphosphine.

It is possible to repeat individual treatments (in each case in a further tank with a bath of the same composition as the preceding bath) and in some cases better utilisation of the bath can be achieved by this means. When the number of available tanks and the time permit, it is also possible to inset waterbaths between baths of different action. It is left to those skilled in the art to determine, from the sensitometric results, the optimum ratio, depending on the nature of the catalysts selected. All of the baths can contain further conventional additives, for example hardeners, wetting agents, fluorescent brighteners or UV stabilisers.

Baths of conventional composition can be used for silver developing, for example baths which contain hydroquinone as the developer substance and can additionally contain 1-phenyl-3-pyrazolidinone. Optionally, a bleach catalyst of groups I or II can already by present in the silver developing bath.

The silver fixing bath can be of known and conventional composition. The fixer used is, for example, sodium thiosulfate or, advantageously, ammonium thiosulfate, if desired with additives such as sodium bisulfite and/or sodium metabisulfite.

The process according to the invention can be used, for example, in the production of positive coloured images in automatic copying or recording machines or in the rapid processing of other silver dye-bleach materials, for example for scientific recording and industrial purposes, for example coloured photofluorography, and also for the production of coloured negatives and diffusion transfer images.

The base used can be a transparent, metallically reflecting or preferably white-opaque material which is not able to absorb any liquid from the baths.

The base can consist, for example, of cellulose triacetate or polyester, which can be pigmented. If it consists of paper fibres, these must be lacquer-coated, or coated with polyethylene, on both sides. The light-sensitive layers are located on at least one side of this base, preferably in the known arrangement, i.e. at the bottom a red-sensitised silver halide emulsion layer, which contains a cyan azo dye, above this a green-sensitised silver halide emulsion layer, which contains a magenta azo dye, and at the top a blue-sensitive silver halide emulsion layer, which contains a yellow azo dye. The material can also contain subbing layers, intermediate layers, filter layers and protective layers, but the total thickness of the layers should as a rule not exceed 20μ.

The method according to the present invention has the advantage that, by suitable mixing of the catalysts to be selected from groups I and II, the sensitometric curves of all three colour layers of a silver dye-bleach material can be brought substantially into alignment, as a result of which neutral grey shades can be produced at all brightness levels between the brightest light regions and the darkest shadow regions.

A further advantage is that the colour gradations which as a rule are too steep when the bleach catalysts of group I are used can be distinctly improved (balanced) by admixture of bleach catalysts having a redox potential at least 15 mV lower from group I or preferably of bleach catalysts from group II, without this resulting in the loss of the advantage of rapid bleaching (reactive bleach catalysts of group I) and thus of short treatment times.

The method according to the invention is also suitable for processing exposed silver dye-bleach material which has a special build-up and is suitable, for example, for the production of self-masked images (German Offenlegungsschrift No. 2,547,720). In this case also, an even further improved colour reproduction can be achieved by the method according to the invention.

This material for the silver dye-bleach process contains a dye, which is bleachable image-wise and has an absorption maximum corresponding to one of the primary colours red, green or blue, in each of at least two layers, a silver halide emulsion sensitive in a specific region of the spectrum being assigned to each dye. This material also contains ($a_3$) a silver halide emulsion layer which consists at least in part of silver iodide and is assigned to the dye which has the undesired secondary colour density which is to be compensated, ($b_3$), in a further layer, at least a second dye, the main colour density of which corresponds to a secondary colour density, which is to be compensated, of the first dye, and a silver halide emulsion free from iodide ions, ($c_3$) a further layer which is adjacent to the layer containing the second dye and contains colloidal seeds which are capable of precipitating metallic silver from soluble silver complexes and ($d_3$) a separating layer between the layer containing the seeds and the dye layer which has the secondary colour density which is to be compensated.

In addition, the silver developing bath with which the material is treated contains a ligand which is able to produce water-soluble, diffusible silver complexes.

EXAMPLE 1

A photographic material for the silver dye-bleach process is produced on a pigmented cellulose acetate base using the cyan image dye of the formula (301)

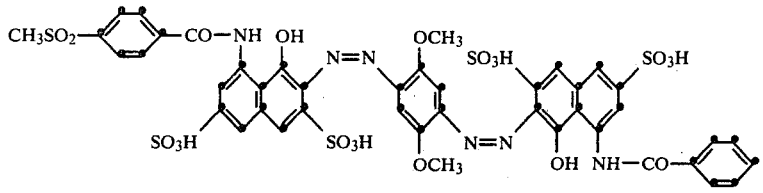

in the red-sensitised bottom-most layer, the magenta dye of the formula (302)

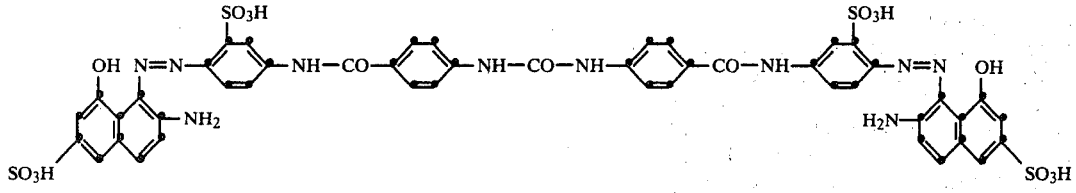

in a green-sensitised layer located above this and the yellow dye of the formula (303)

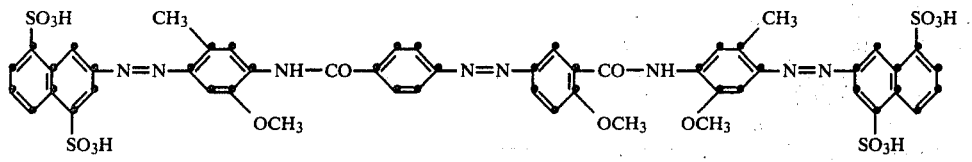

in a blue-sensitive layer located above the magenta layer.

The photographic material used is built up as follows (cf., for example, German Offenlegungsschriften Nos. 2,036,918 and 2,547,720).

Gelatin protective layer
Blue-sensitive, iodide-free AgBr emulsion
Yellow dye (303)+blue-sensitive, iodide-free AgBr emulsion
Yellow filter: yellow Ag hydrosol (10 mg/m$^2$)
Green-sensitive AgBr/AgI emulsion
Magenta dye (302)+green-sensitive AgBr/AgI emulsion
Interlayer (gelatin)
Red-sensitive AgBr/AgI emulsion
Cyan dye (301)+red-sensitive AgBr/AgI emulsion
Cellulose triacetate base, white-opaque
Backing, gelatin The layer build-up enables the blue secondary colour densities of the cyan dye and the magenta dye to be corrected by additional bleaching of the yellow image dye as a function of the bleaching of the other two image dyes.

The iodide-containing emulsion layers contain crystals with 2.6 mol % of silver iodide and 97.4 mol % of silver bromide. The image dyes are used in a concentration such that their remissive density is 2.0 in each case; the total silver content of the 22$\mu$ thick layers is 2.0 g/m$^2$.

This material is exposed beneath a coloured slide in an enlarger. The exposed material is processed in a hand developing drum at 24° C. For this purpose, 100 ml of each of the processing solutions having the following compositions are used.

The positive reflection copy of the slide which is obtained after drying is distinguished by unadulterated colour reproduction and flawless total contrast. In particular, the three colour gradations are in balance to such an extent that neutral grey image areas in the slide are reproduced in all brightness levels without a colour tinge.

| | | | |
|---|---|---|---|
| 1. Silver developing bath | | | 3 minutes |
| The tetrasodium salt of ethylenediamine-tetraacetic acid | 2 | g/l | |
| Potassium hydroxide (85%) | 30 | g/l | |
| Boric acid | 16 | g/l | |
| Potassium metabisulfate | 26 | g/l | |
| 1-Phenyl-3-pyrazolidinone | 1.6 | g/l | |
| Hydroquinone | 7 | g/l | |
| Benztriazole | 0.8 | g/l | |
| Potassium bromide | 2.5 | g/l | |
| Anhydrous sodium thiosulfate | 0.8 | g/l | |
| 2. Washing | | | 20 seconds |
| 3. Bleaching bath | | | 4 minutes |
| p-Toluenesulfonic acid . $H_2O$ | 110 | g/l | |
| Na m-nitrobenzenesulfonate | 8 | g/l | |
| Bis-($\beta$-cyanoethyl)-sulfoethyl-phosphine (sodium salt) | 6.5 | g/l | |
| Potassium iodide | 8 | g/l | |
| Compound of the formula (102) | 1.2 | g/l | |
| Compound of the formula (201) | 2.3 | g/l | |
| 4. Fixing bath | | | 4 minutes |
| Ammonium thiosulfate | 250 | g/l | |
| Potassium metabisulfite | 50 | g/l | |
| Potassium hydroxide, 85% | 20 | g/l | |
| 5. Washing | | | 5 minutes |
| Total processing time | | | 16 minutes 20 seconds |

EXAMPLE 2

The material used in Example 1 is exposed behind a grey wedge with additive colour filters in blue, green and red. In order to investigate the mode of action of the dye-bleach catalysts, the exposed material is processed three times in accordance with Example 1; for this, the composition of the bleaching bath is varied as follows in respect of the amount of the two bleach catalysts (compounds of the formulae (102) and (201):

| | Compound of the formula | |
|---|---|---|
| | (102) g/l | (201) g/l |
| (1) Bleaching bath according to Example 1 | 1.2 | 2.3 |
| (2) Bleaching bath according to Example 1 | 1.2 | — |
| (3) Bleaching bath according to Example 1 | — | 2.3 |

Figure 2:
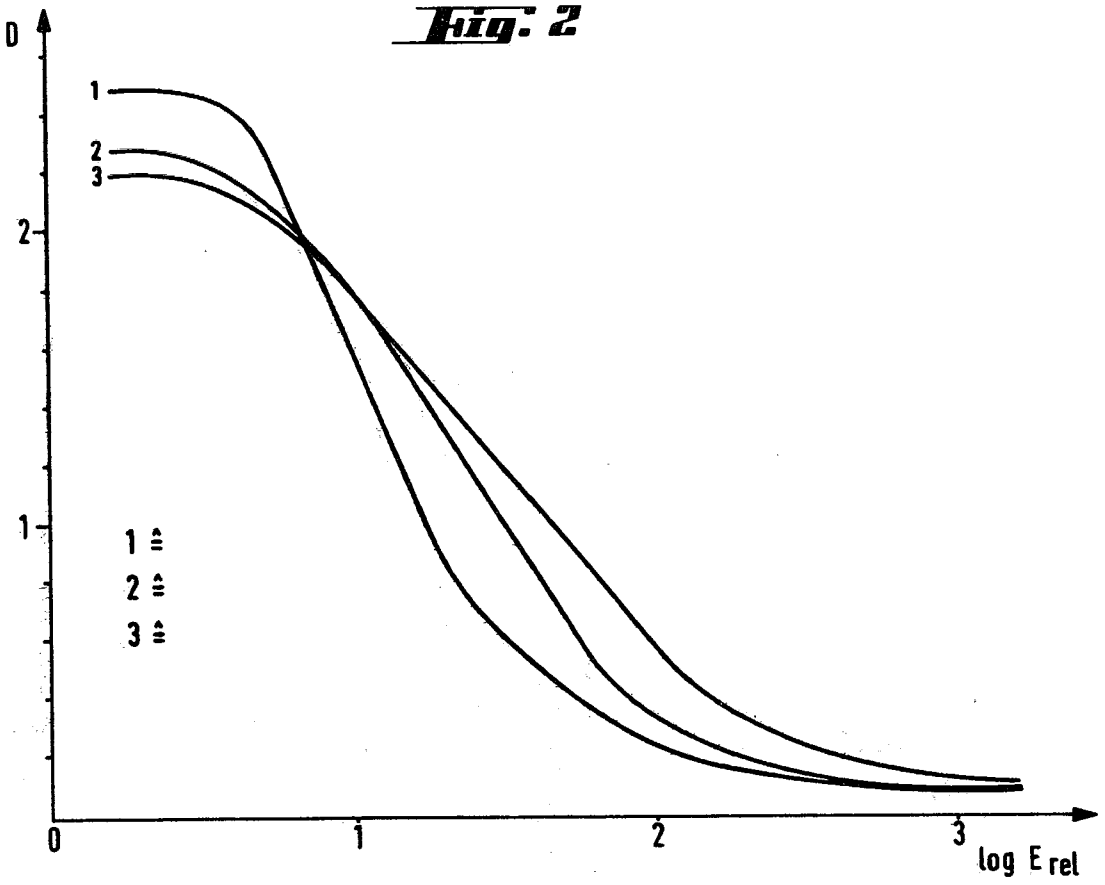
Figure 3:
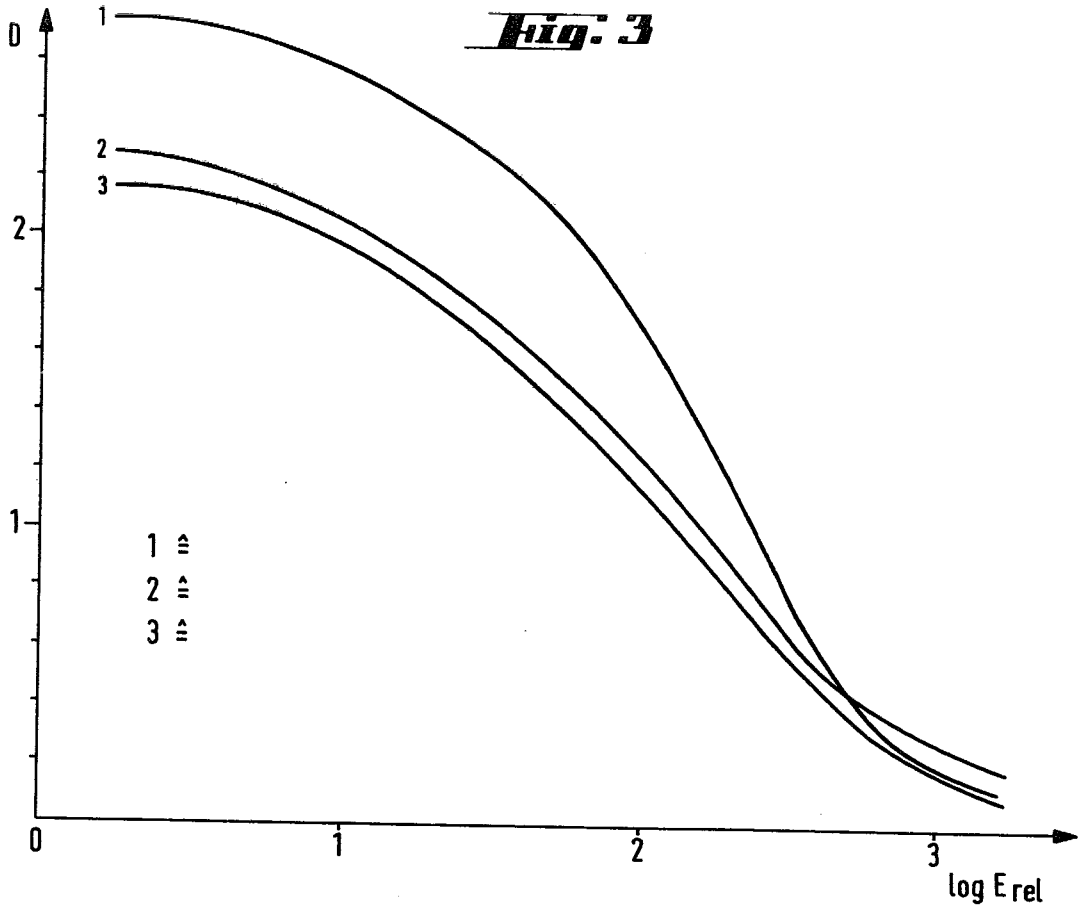

The three wedges obtained after drying were measured in a densitometer with three colour filters and plotted as integral density curves in FIGS. 1 to 3 (corresponding to processes (1) to (3)). In the FIGS. D is the colour density and $E_{rel}$ is the relative exposure (exposure energy); the blue curve is designated (1), the green curve is designated (2) and the red curve is designated (3). It can be seen from FIGS. 2 and 3 that the three colour gradations show wide variations in respect of contrast and the shape of the curve. The colour curves after processing 2 (FIG. 2) show high sensitivity, but steep gradation for the blue curve and the green curve. In FIG. 3, on the other hand, the colour sensitivities are low; the activity of the bleaching bath composition containing the catalyst of the formula (201) on its own is low. The surprising combination effect of the two bleach catalysts can be seen in FIG. 1. With good total contrast and high sensitivity, the colour gradations are so in balance that the image obtained of the original grey wedge is neutral within a wide brightness range.

EXAMPLE 3

Similar combination effects are obtained when exposed silver dye-bleach material is processed as in Example 1, but the following bleach catalysts are used in the bleaching bath:

TABLE 3

| | Bleach catalyst (compound of the formula) | | | |
|---|---|---|---|---|
| | I | g/l | II | g/l |
| A | (102) | 0.8 | (103) | 3 |
| B | (102) | 1 | (215) | 1.8 |
| C | (102) | 0.5 | (205) | 3 |
| D | (102) | 0.8 | (206) | 1.5 |
| E | (102) | 0.6 | (207) | 2.8 |
| F | (101) | 0.2 | (203) | 2.5 |
| G | (103) | 1 | (201) | 1 |
| H | (108) | 0.5 | (201) | 2 |
| I | (108) | 0.7 | (207) | 3 |
| K | (104) | 1.5 | (201) | 2.5 |
| L | (104) | 1 | (207) | 2 |
| M | (104) | 1.2 | (217) | 2.5 |

What is claimed is:

1. A method for processing imagewise exposed silver dye-bleach materials comprising the process steps (1) silver developing, (2) dye bleaching and silver bleaching, (3) silver fixing and (4) washing, wherein for the combined dye bleaching and silver bleaching a preparation is applied which contains (a) a strong acid, (b) a water-soluble iodide, (c) a water-soluble oxodizing agent, (d) an antioxidant, (e) substituted or unsubstituted benzo- or pyrido-[c]-cinnolines, substituted or unsubstituted pyrazines and quinoxalines or quinoxalines containing additional fused 5-membered or 6-membered rings, as bleach catalysts, said component (e) is a mixture of at least one bleach catalyst (I) with a redox potential between +150 mV and −30 mV and ($a_1$) at least one bleach catalyst of the same group or ($a_2$) at least one bleach catalyst (II) with a redox potential between −30 and −125 mV, the difference between the redox potentials of the bleach catalysts being at least 15 mV.

2. A method for processing imagewise exposed silver dye-bleach materials comprising the process steps (1) silver developing, (2) dye bleaching and silver bleaching, (3) silver fixing and (4) washing, wherein for the combined dye bleaching and silver bleaching a preparation is applied which contains (a) a strong acid, (b) a water-soluble iodide, (c) a water-soluble oxidizing agent, (d) an antioxidant, (e) substituted or unsubstituted benzo- or pyrido-[c]-cinnolines, substituted or unsubstituted pyrazines and quinoxalines or quinoxalines containing additional fused 5-membered or 6-membered rings, as bleach catalysts and (f), a bleaching accelerator, said component (e) is a mixture of at least one bleach catalyst (I) with a redox potential between +150 mV and −30 mV and ($a_1$) at least one bleach catalyst of the same group or ($a_2$) at least one bleach catalyst (II) with a redox potential between −30 and 125 mV, the difference between the redox potentials of the bleach catalysts being at least 15 mV.

3. A aqueous preparation, for combined dye bleaching and silver bleaching, which contains (a) a strong acid, (b) a water soluble iodide, (c) a water-soluble oxidizing agent, (d) an antioxidant, (e) substituted or unsubstituted benzo- or pyrido-[c]-cinnolines, substituted or unsubstituted pyrazines and quinoxalines or quinoxalines containing additional fused 5-membered or 6-membered rings as bleach catalysts and (f) a bleaching accelerator wherein the bleach catalysts are a mixture of at least one bleach catalyst (I) with a redox potential between +105 mV and −30 mV and ($a_1$) at least one bleach catalyst from the same group or ($a_2$) at least one bleach catalyst (II) with a redox potential between −30 and +125 mV, the difference between the redox potentials of the bleach catalysts being at least 15 mV.

4. A method according to claim 1, wherein component (e) is a quinoxaline which is substituted in the 2-, 3-, 5-, 6-, 7- and/or 8-position and contains up to 4 substituents.

5. A method according to claim 1, wherein the substituents are methyl, methoxy, hydroxymethyl, sulfomethyl, sulfoethoxy, sulfopropoxy, hydroxyl, amino, acetylamino or methylsulfonylamino.

6. A method according to claim 1, wherein the bleach catalysts of group I are 2,3-dimethyl-quinoxaline, 2,3,6-trimethyl-quinoxaline, 6-methoxy-2,3-dimethyl-quinoxaline, 6-hydroxy-2,3-dimethylquinoxaline, 6-(2-hydroxy-ethoxy)-2,3-dimethyl-quinoxaline, 6-(3-sulfopropoxy)-2,3-dimethyl-quinoxaline, 6-amino-2,3,7-trimethyl-quinoxaline, 6-amino-2,3-dimethyl-quinoxaline, 6-hydroxymethyl-2,3-dimethyl-quinoxaline, 6-sulfomethyl-2,3-dimethyl-quinoxaline, 6-acetamido-2,3-dimethylquinoxaline, 6-acetamido-2,3,7-trimethyl-quinoxaline, 6-methanesulfonamido-2,3-dimethyl-quinoxaline, 6-methanesulfonamide-2,3,7-trimethyl-quinoxaline, 6,7-dimethoxyquinoxaline, 2,3-dihydro-7-methyl-8-sulfomethyl-dioxino-[2,3-g]-quinoxaline, 3-hydroxy-benzo-[c]-cinnoline and 3-(3-sulfopropoxy)-benzo-[c]-cinnoline, 6,7-dimethylimidazolo-[4,5-g]-quinoxaline, 2,6,7-trimethyl-imidazolo-[4,5-g]-quinoxaline and 7-amino-2,3-dimethyl-quinoxaline and the bleach catalysts of group II are 6-hydroxy-2,3,7-trimethyl-quinoxaline, 6,7-dimethoxy-2,3-dimethyl-quinoxaline, 6,7-dimethyl-dioxolo-[4,5-g]-quinoxaline, 6-methoxy-2,3,7-trimethyl-quinoxaline, 2,3,6,7-tetramethyl-quinoxaline, 6-amino-7-methoxy-2,3-dimethyl-quinoxaline, 6-methoxy-2,3-dimethyl-7-(3-sulfopropanoxy)-quinoxaline, 6,7-dimethoxy-2-methyl-3-sulfomethyl-quinoxaline, 6-methoxy-2,3-dimethyl-7-(2-sulfoethoxy)-quinoxaline, 2-hydroxymethyl-6,7-dimethoxy-3-methyl-quinoxaline, 6-methyl-dioxo-[4,5-g]-quinoxaline, 6-methyl-7-sulfomethyl-dioxolo-[4,5-g]-quinoxaline, 6-hydroxymethyl-7-methyl-dioxolo-[4,5-g]-quinoxaline, 2,3-dihydro-7,8-dimethyl-dioxino-[2,3-g]-quinoxaline, 6-hydroxy-7-methoxy-2,3-dimethyl-quinoxaline, 2,3-dihydro-7-hydroxymethyl-8-methyl-dioxino-[2,3-g]-quinoxaline, 5-amino-6-methoxy-2,3-dimethyl-quinoxaline, 2,7,8-trimethylimidazolo-[4,5-f]-quinoxaline, 4-methoxy-2,7,8-trimethylimidazolo-[4,5-f]-quinoxaline, 7,8-dimethyl-imidazolo-[4,5-f]-quinoxaline, 4-methoxy-7,8-dimethyl-imidazolo-[4,5-f]-quinoxaline, 2,3,8,9-tetramethyl-pyrazino-[2,3-f]-quinoxaline, 5-amino-2,3-dimethyl-quinoxaline, pyrazine and methylpyrazine.

7. A method according to claim 6, wherein the bleach catalysts of group I are 2,3-dimethyl-quinoxaline, 2,3,6-trimethyl-quinoxaline, 7-methoxy-2,3-dimethyl-quinoxaline, 7-hydroxy-2,3-dimethyl-quinoxaline and 6-amino-2,3-dimethyl-quinoxaline and the bleach catalysts of group II are 7-methoxy-2,3-dimethyl-quinoxaline, 7-hydroxy-2,3,6-trimethyl-quinoxaline, 6,7-dimethyl-dioxolo-[4,5-g]-quinoxaline, 2,3,6,7-tetramethyl-quinoxaline, 6-methoxy-7-amino-2,3-dimethyl-quinoxaline, 7[3-sulfopropoxy]-6-methoxy-2,3-dimethyl-quinoxaline, 6-hydroxy-7-methoxy-2,3-dimethyl-quinoxaline and 5-amino-7-methoxy-2,3-dimethylquinoxaline.

8. A method according to claim 1, wherein the bleaching preparation contains, as component (a), sulfuric acid, sulfamic acid or toluenesulfonic acid.

9. A method according to claim 1, wherein component (b) is sodium iodide or potassium iodide.

10. A method according to claim 1, wherein component (c) is an aromatic mono- or di-nitro compound or an anthraquinone.

11. A method according to claim 1 wherein component (d) is a reductones or a water-soluble mercapto compound.

12. A method according to claim 11, wherein component (d) is a mercaptan of the formula $H\text{-}S\text{-}C_qH_{2q}\text{-}B$, in which q is an integer with a value of 2 to 12 and B is a sulfonic acid group or carboxylic acid group.

13. A method according to claim 1, wherein component (d) is an alkali metal, alkaline earth metal or ammonium bisulfite adduct of an organic carbonyl compound.

14. A method according to claim 1, wherein component (f) is a quaternary, substituted or unsubstituted piperidine, piperazine, pyrazine, quinoline or pyridine compound or also a tetraalkylammonium or a alkylenediammonium compounds.

15. A method according to claim 1, wherein component (f) and/or (d) are/is a water-soluble tertiary phosphine of the formula

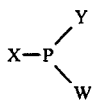

in which W is $—C_rH_{2r}CN$, $—C_rH_{2r}NO_2$ or a substituted or unsubstituted aryl radical or a heterocyclic radical, r is 1 to 25, X is substituted or unsubstituted alkyl and Y is hydroxyalkyl, alkoxyalkyl, sulfoalkyl, aminoalkyl, phenyl, sulfophenyl or pyridyl.

16. A method according to claim 1, in which the photographic silver dye-bleach material contains, in each of at least two layers, a dye which is bleachable image-wise and has an absorption maximum corresponding to one of the primary colours red, green or blue, a silver halide emulsion sensitive in a specific region of the spectrum being assigned to each dye and, in the said material, ($a_3$) a silver halide emulsion layer, which consists at least in part of silver iodide, being assigned to the dye which has the undesired secondary colour density which is to be compensated, ($b_3$) at least a second dye, the main colour density of which corresponds to a secondary colour density, which is to be compensated, of the first dye, and a silver halide emulsion free from iodide ions being present in a further layer, ($c_3$) a further layer, which is adjacent to that which contains the second dye, containing colloidal seeds which are capable of precipitating metallic silver from soluble silver complexes and ($d_3$) an interlayer being located between the layer containing the seeds and the dye layer which has the secondary colour density which is to be compensated, and the bath for silver developing (1), with which the material is treated prior to the combined dye bleaching and silver bleaching (2), containing a ligand which is able to produce water-soluble, diffusible silver complexes, wherein component (e) according to claim 1 is present in the combined dye bleaching and silver bleaching bath.

17. A method according to claim 1, wherein the silver developing bath also contains at least one of the bleach catalysts of component (e) according to claim 1.

18. A method according to claim 1, wherein the entire processing, from developing to the material leaving the final bath, is carried out at temperatures of 20° to 90° C. and preferably of 20° to 60° C.

19. An aqueous preparation, for combined dye bleaching and silver bleaching, which contains (a) a strong acid, (b) a water-soluble iodide, (c) a water-soluble oxidizing agent, (d) an antioxidant, (e) substituted or unsubstituted benzo- or pyrido-[c]-cinnolines, substituted or unsubstituted pyrazines and quinoxalines or quinoxalines containing additional fused 5-membered or 6-membered rings, as bleach catalysts, wherein the bleach catalysts are a mixture of at least one bleach catalyst (I) with a redox potential between +105 mV and −30 mV and ($a_1$) at least one bleach catalyst from the same group or ($a_2$) at least one bleach catalyst (II) with a redox potential between −30 and 125 mV, the difference between the redox potentials of the bleach catalysts being at least 15 mV.

20. An aqueous preparation according to claim 19, which contains 2,3-dimethyl-quinoxaline, 2,3,6-trimethylquinoxaline, 6-methoxy-2,3-dimethyl-quinoxaline, 6-hydroxy-2,3-dimethyl-quinoxaline, 6-(2-hydroxyethoxy)-2,3-dimethyl-quinoxaline, 6-(3-sulfo-propoxy)-2,3-dimethyl-quinoxaline, 6-amino-2,3,7-trimethyl-quinoxaline, 6-amino-2,3-dimethyl-quinoxaline, 6-hydroxymethyl-2,3-dimethyl-quinoxaline, 6-sulfomethyl-2,3-dimethyl-quinoxaline, 6-acetamido-2,3-dimethyl-quinoxaline, 6-acetamido-2,3,7-trimethyl-quinoxaline, 6-methanesulfonamido-2,3-dimethyl-quinoxaline, 6-methanesulfonamido-2,3,7-trimethylquinoxaline, 6,7-dimethoxy-quinoxaline, 2,3-dihydro-7-methyl-8-sulfomethyl-dioxino-[2,3-g]-quinoxaline, 3-hydroxy-benzo-[c]-cinnoline, 3-(3-sulfopropoxy)-benzo-[c]-cinnoline, 2,6,7-trimethyl-imidazo-[4,5-g]-quinoxaline, 6,7-dimethyl-imidazo-[4,5-g]-quinoxaline or 7-amino-2,3-dimethyl-quinoxaline as the bleach catalyst of group I and 6-hydroxy-2,3,7-trimethyl-quinoxaline, 6,7-dimethoxy-2,3-dimethyl-quinoxaline, 6,7-dimethyl-dioxolo-[4,5-g]-quinoxaline, 6-methoxy-2,3,7-trimethyl-quinoxaline, 2,3,6,7-tetramethyl-quinoxaline, 6-amino-7-methoxy-2,3-dimethyl-quinoxaline, 6-methoxy-2,3-dimethyl-7-(3-sulfopropoxy)-quinoxaline, 6,7-dimethoxy-2-methyl-3-sulfomethyl-quinoxaline, 6-methoxy-2,3-dimethyl-7-(2-sulfoethoxy)-quinoxaline, 2-hydroxymethyl-6,7-dimethoxy-3-methyl-quinoxaline, 6-methyl-dioxolo-[4,5-g]-quinoxaline, 6-methyl-7-sulfomethyl-dioloxo-[4,5-g]-quinoxaline, 6-hydroxymethyl-7-methyl-dioxolo-[4,5-g]-quinoxaline, 2,3-dihydro-7,8-dimethyl-dioxino-[2,3-g]-quinoxaline, 6-hydroxy-7-methoxy-2,3-dimethyl-quinoxaline, 2,3-dihydro-7-hydroxymethyl-8-methyl-dioxino-[2,3-g]-quinoxaline, 5-amino-6-methoxy-2,3-dimethyl-quinoxaline, 2,7,8-trimethylimidazolo-[4,5-f]-quinoxaline, 4-methoxy-2,7,8-trimethylimidazolo-[4,5-f]-quinoxaline, 7,8-dimethyl-imidazolo-[4,5-f]-quinoxaline, 4-methoxy-7,8-dimethyl-imidazolo-[4,5-f]-quinoxaline, 2,3,8,9-tetramethyl-pyrazino-[2,3-f]-quinoxaline, 6,7-dimethyl-imidazolo-[4,5-g]-quinoxaline, pyrazine or methylpyrazine as the bleach catalyst of group (II).

21. An aqueous preparation according to claim 19, wherein 2,3-dimethyl-quinoxaline, 2,3,6-trimethyl-quinoxaline, 7-methoxy-2,3-dimethyl-quinoxaline, 7-hydroxy-2,3-dimethyl-quinoxaline or 6-amino-2,3-dimethyl-quinoxaline is used as the bleach catalyst of group I and 7-methoxy-2,3-dimethyl-quinoxaline, 7-hydroxy-2,3,6-trimethylquinoxaline, 6,7-dimethyl-dioxolo-[4,5-g]-quinoxaline, 2,3,6,7-tetramethyl-quinoxaline, 6-methoxy-7-amino-2,3-dimethyl-quinoxaline, 7-[3-sulfopropoxy]-6-methyl-2,3-dimethyl-quinoxaline, 6-hydroxy-7-methoxy-2,3-dimethylquinoxaline or 5-amino-7-methoxy-2,3-dimethyl-quinoxaline is used as the bleach catalyst of group II.

22. An aqueous preparation according to claim 19, which contains 0.05 to 10 g/l of the bleach catalyst.

23. An aqueous preparation according to claim 19, which contains 10 to 200 g/l of component (a), 2 to 50 g/l of component (b), 1 to 30 g/l of component (c), 0.5 to 10 g/l of component (d), 0.05 to 10 g/l of component (e) and optionally 1 to 5 g/l of component (f).

24. A concentrate for the preparation of an aqueous preparation according to claim 19, which contains components (a) to (e) and optionally (f) in a concentration, per liter of concentrate, which is two to twenty times higher than that in the ready-for-use aqueous preparation.

25. Partial concentrates for the preparation of an aqueous preparation according to claim 19, which are a concentrate containing components (a) and (c) and a second concentrate containing components (b), (d), (e) and optionally (f), the concentration of the components per liter of concentrate being two to twenty times higher than that in the ready-for-use aqueous preparation.

26. Partial concentrates for the preparation of an aqueous preparation according to claim 19, which are concentrates of each of components (a) to (e) and optionally (f), the concentration of the components per liter of concentrate being two to twenty times higher than that in the ready-for-use aqueous preparation.

* * * * *